US007331764B1

(12) United States Patent
Reynolds et al.

(10) Patent No.: US 7,331,764 B1
(45) Date of Patent: Feb. 19, 2008

(54) HIGH-STRENGTH LOW-WEIGHT FAN BLADE ASSEMBLY

(75) Inventors: John R. Reynolds, Fortville, IN (US); Jay S. Porter, Fort Wayne, IN (US)

(73) Assignee: Vee Engineering, Inc., Anderson, IN (US)

( * ) Notice: Subject to any disclaimer, the term of this patent is extended or adjusted under 35 U.S.C. 154(b) by 252 days.

(21) Appl. No.: 10/827,601

(22) Filed: Apr. 19, 2004

(51) Int. Cl.
*F04D 29/34* (2006.01)

(52) U.S. Cl. ..... 416/204 R; 416/223 R; 416/230

(58) Field of Classification Search ..... 416/169 A, 416/203, 204 R, 213 A, 214 R, 230, 241 A, 416/237, 238, 223 R, 243; 428/297.4, 299.4, 428/301.4; 442/148, 180, 287, 288, 395, 442/396

See application file for complete search history.

(56) References Cited

U.S. PATENT DOCUMENTS

| | | | | | |
|---|---|---|---|---|---|
| 2,072,322 | A | | 3/1937 | Upson | |
| 2,559,831 | A | | 7/1951 | Roffy | |
| 2,581,873 | A | | 1/1952 | Morrison | |
| 3,885,888 | A | * | 5/1975 | Warhol | 416/203 |
| 4,046,488 | A | | 9/1977 | Wickham | |
| 4,357,913 | A | | 11/1982 | Hori et al. | |
| 4,671,739 | A | * | 6/1987 | Read et al. | 416/230 |
| 4,746,271 | A | | 5/1988 | Wright | |
| 4,791,713 | A | | 12/1988 | Robb | |
| 4,871,298 | A | | 10/1989 | Vera | |
| 4,957,414 | A | | 9/1990 | Willingham | |
| 5,123,814 | A | * | 6/1992 | Burdick et al. | 416/230 |
| 5,226,804 | A | | 7/1993 | Do | |
| 5,672,417 | A | * | 9/1997 | Champenois et al. | 416/230 |
| 6,010,308 | A | | 1/2000 | Youn | |
| 6,595,744 | B2 | | 7/2003 | Van Houten | |

FOREIGN PATENT DOCUMENTS

| | | | | | |
|---|---|---|---|---|---|
| DE | 759535 | | | 1/1953 | |
| DE | 759535 | A | * | 1/1953 | 416/214 R |
| JP | 54-122410 | A | * | 9/1979 | 416/203 |
| SE | 169221 | A | * | 11/1959 | 416/214 R |
| WO | WO-03/078833 | A1 | * | 9/2003 | |

* cited by examiner

*Primary Examiner*—Richard Edgar
(74) *Attorney, Agent, or Firm*—John V. Daniluck; Bingham McHale LLP

(57) ABSTRACT

An engine cooling fan system including a hub disc about which first and/or second pluralities of elongated fan blades characterized by a first and second respective pitch angles may be fastened. Each respective fan blade further comprises a hub-engaging portion, a twisted transition portion and an air-engaging portion. Each fan blade is formed from a composite material having a thermoset resin matrix phase and an evenly dispersed continuous fiber reinforcement phase.

8 Claims, 10 Drawing Sheets

HIGH-STRENGTH LOW-WEIGHT FAN BLADE ASSEMBLY

TECHNICAL FIELD OF THE INVENTION

The invention relates generally to cooling fan assemblies and, more specifically, to engine cooling fans with thermoset-resin composite fan blades.

BACKGROUND OF THE INVENTION

A variety of fan blades have been developed for use in automotive cooling systems. The fan blades operate to produce a flow of air over heat exchangers to cool the engine. Thus, the fan blades of an engine-cooling fan must be capable of withstanding the harsh temperature and chemical conditions present in an engine environment. Also, it is important that engine cooling fans be formed with minimal mass, since fan mass is generally inversely related to the operating life of other operationally related engine fan drive components, such as bearings, the water pump, and the like. It is, therefore, desired that engine cooling fan blades be designed to be both chemically and mechanically durable materials, as well as being lightweight as possible.

The construction of typical prior art cooling fans has required a compromise between the physical durability and the overall weight of the fans. Prior art fan blades have traditionally been made from durable structural metallic materials, such as heavy gauge steel or aluminum. As shown in FIG. 1, a prior art metal spider fan 10, which is a metal disk or hub 12 from which a plurality of twisted legs 14*a* extend, is provided to which a plurality of fan blades 30 are attached. The legs 14*a* are twisted to provide an appropriate angular displacement for the blades 30, which are fastened to the spider legs 14*a*, typically by bolts, welds, or rivets. Due to the forces experienced by the spider legs 14*a*, the spider legs typically require a stress relieving treatment as a step in the spider manufacturing process, to minimize the introduction of weaknesses in the form of excess embrittlement through strain hardening, small cracks or other imperfections inherent in the spider leg twist operation that could impair the structural integrity of the fan and thus shorten the operating life of the fan.

Certain other prior art fan blades, as shown in FIG. 2, have been constructed of thermoplastic materials, such as injection-molded nylon. These prior art blades include short reinforcing fibers dispersed in a thermoplastic matrix, and are used to form entire, unitarily molded fan assemblies (i.e., hubs with multiple contiguously formed fan blades extending therefrom) via a high-pressure injection molding process. These fans, while lighter than comparably strong metal fan assemblies, still suffer from the drawbacks of requiring relatively expensive molds for use in costly injection molding processes. Moreover, in order to alter the geometry of the fan blades, an entire new fan must be molded, thereby requiring a new, separate mold.

Thus, there remains a need for a high-strength, lightweight and relatively low cost fan blade system. The present invention addresses this need.

SUMMARY OF THE INVENTION

The present invention relates to a engine cooling fan assembly including a generally circular hub member to which a plurality of elongated fan blade members are directly connected. Each respective fan blade member includes a hub-connecting portion, a transition portion and a blade portion and is formed from a composite material including a thermoset resin matrix phase and a dispersed continuous fiber reinforcement phase. One object of the present invention is to provide an improved engine cooling fan blade. Related objects and advantages of the present invention will be apparent from the following description.

DESCRIPTION OF THE PREFERRED EMBODIMENTS

Figure 1:
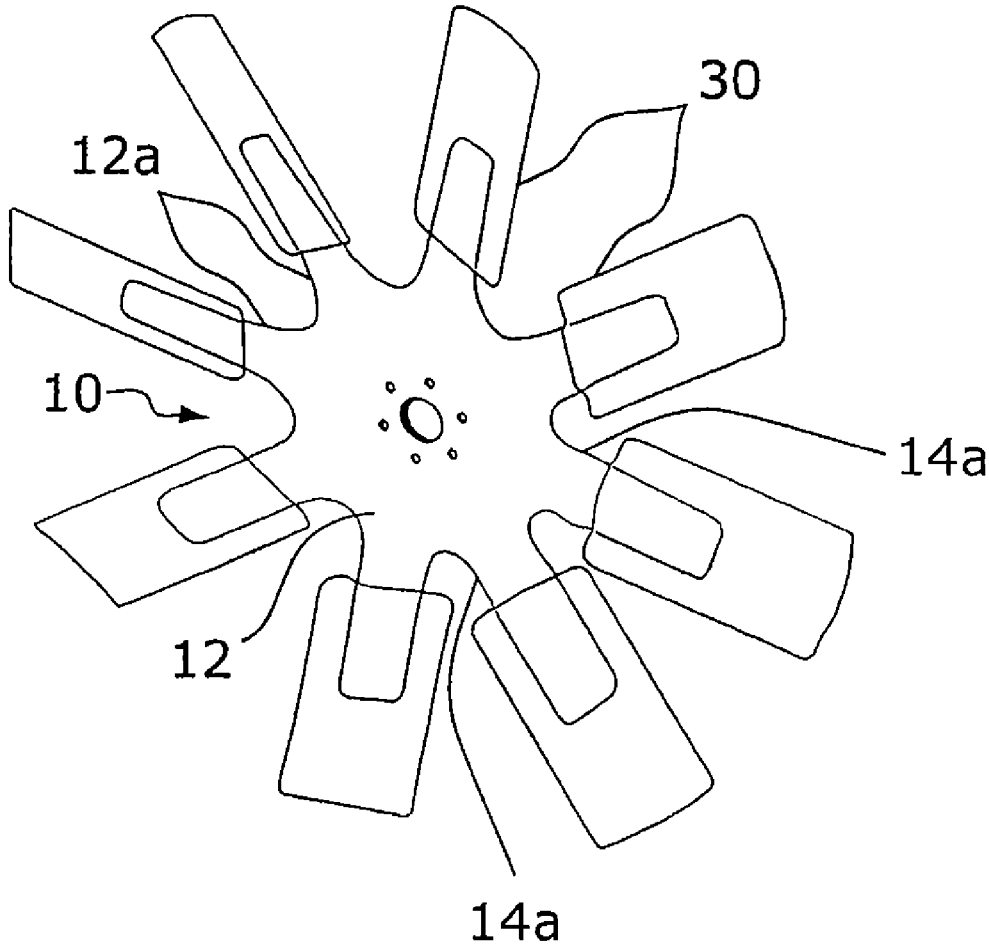
Prior Art FIG. 1
FIG. 1 is a perspective view of a prior art engine cooling spider and fan blade assembly.
Figure 2:
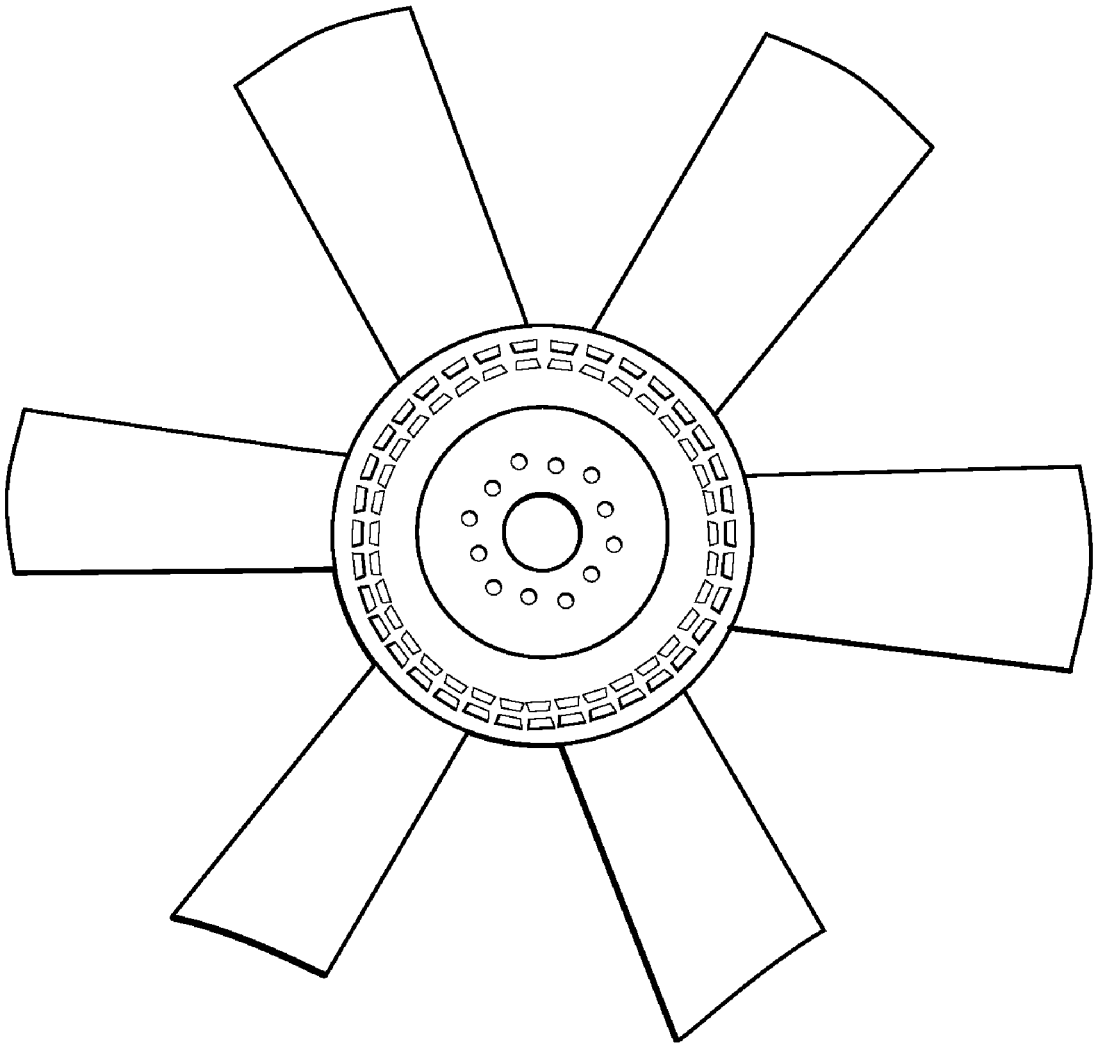
Prior Art FIG. 2
FIG. 2 is a perspective view of a prior art injection-molded nylon fan blade.
Figure 3:
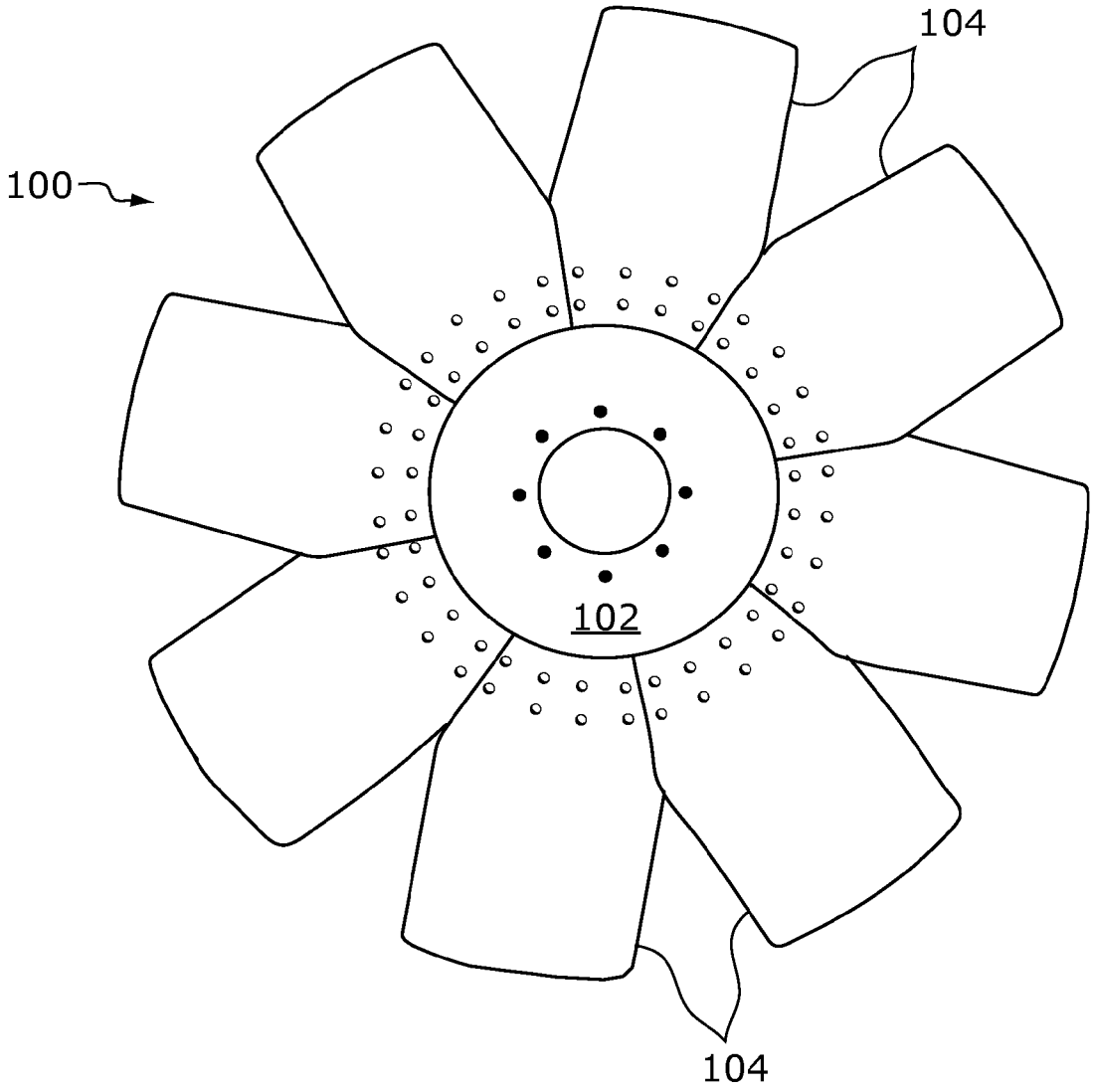
FIG. 3 is a top plan view of a fan blade assembly including a hub portion to which a plurality of independently formed fan blade portions are directly connected, according to a first preferred embodiment of the present invention.
Figure 4:
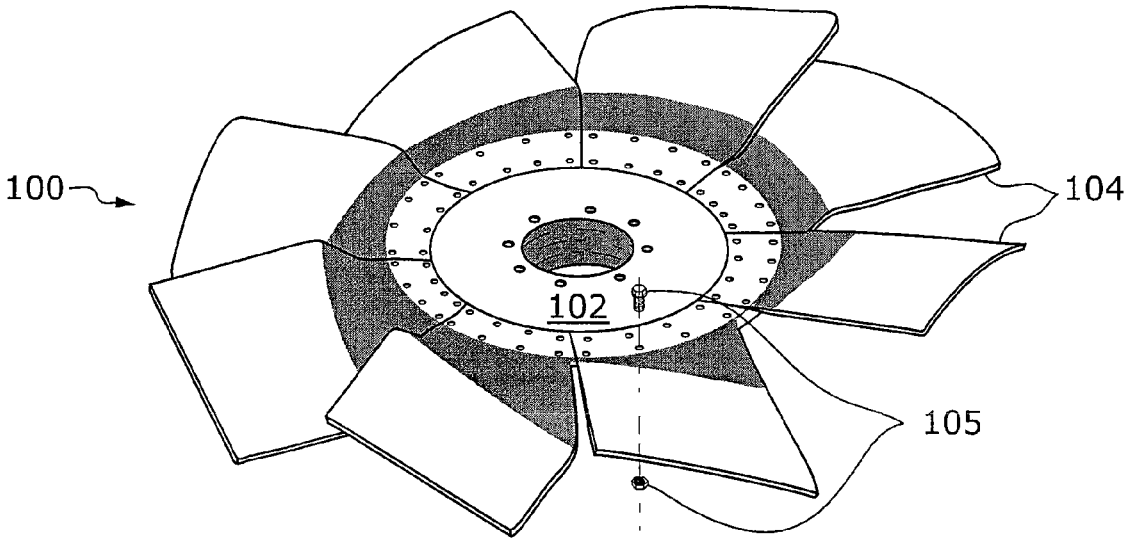
FIG. 4 is a perspective view of the embodiment of FIG. 3.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

FIGS. 3-8 relate to a first embodiment of the present invention, an axial fan blade system 100 suitable for engine cooling purposes. The fan blade system 100 incorporates a generally circular or annular hub disc 102 to which fan blade members 104 may be fastened. The fan blade members 104 are preferably spaced substantially evenly about the hub disc 102 for most anticipated systems 100, although other blade configurations are possible. The fan blades 104 are preferably formed from thermoset resin composite materials with a reinforcing fiber phase typically substantially evenly dispersed in a resin matrix phase, and are more preferably composed of a vinyl ester, thermoset resin matrix incorporating a continuous fiber supporting phase. The preferred formation process is molding, with the entire blade 104 formed at once. The reinforcing phase is preferably a continuous strand material and is more preferably in the form of a fabric, woven or mat material. While the reinforcing phase is still more preferably a continuous strand vitreous or glass fabric, any continuous fibrous or fibrous fabric material may be chosen. Such fan blades 104 have less mass (i.e., are lighter in weight) than conventional steel or aluminum blades while having comparable strength. The blades 104 also preferably have densities of between about 85 and 125 pounds per cubic foot, and more preferably of about 100 pounds per cubic foot.

In addition to being less dense than comparable metal blades, the composite fan blades 104 are also much stronger than nylon fans over the engine fan operating temperature range (typically about one hundred and seventy five degrees Fahrenheit (175° F.) or about eighty degrees Celsius (80° C.,) but as high as about four hundred degrees Fahrenheit (400° F.) or about two-hundred and fifty degrees Celsius (250° C.).) At 175° F., the tensile strength (in PSI) to weight (in pounds) index of standard AIAI/SAE 1010 steel is about 105 and that of 5083H-32 aluminum is about 213. Likewise, the strength to weight index of a typical thermoplastic material (such as Nylon with 33% glassy phase) is about 150. In contrast, the strength-to-weight index of the preferred composite material (i.e., a vinyl ester thermoset resin matrix incorporating a dispersed continuous glassy fiber reinforcing phase) is preferably at least about 300 and more preferably at least about 340. In other words, the preferred composite has a strength-to-weight index of at least about 3 times that of 1010 steel. It should be noted that the strength of the composite material has an inherent directional dependency; in the above example, wherein the strength-to-weight index is at least about 340, in the stronger direction the strength-to-weight index preferably increases to about 420. Moreover, this strength-to-weight index is substantially stable up to temperatures in excess of about four hundred degreed Fahrenheit (400° F.).

The decreased density of the composite material combined with its increased strength-to-weight index (relative to conventional prior art fan blade materials) allows the instant fan blades 104 to be made having the same or greater strength while using less of the lighter weight composite material. Thus, the instant fan blades 104 are substantially less massive than the prior art fan blades. Further, operating a fan assembly 100 with the lighter blades 104 puts less strain and wear and tear on the associated fan drive components, such as bearings, belts, water pumps, fan motors (both hydraulic and/or electric) and the like, resulting in a more efficient and longer lasting fan assembly 100.

Figure 5A:
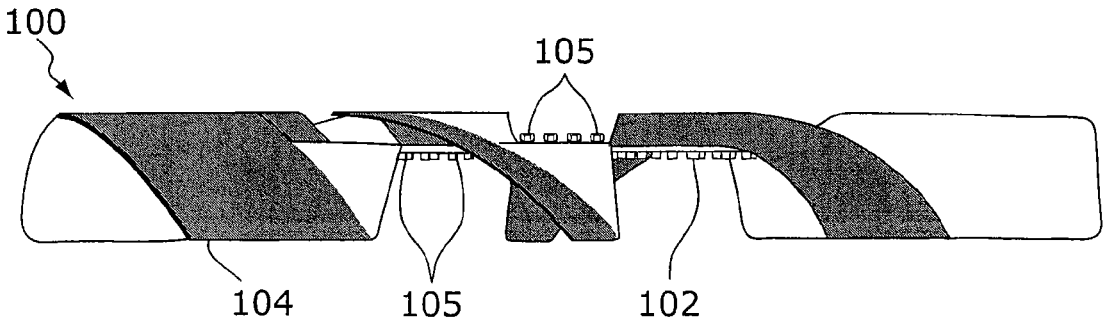
FIG. 5A is a side elevational view of FIG. 3 including mechanical fasteners.
Figure 5B:
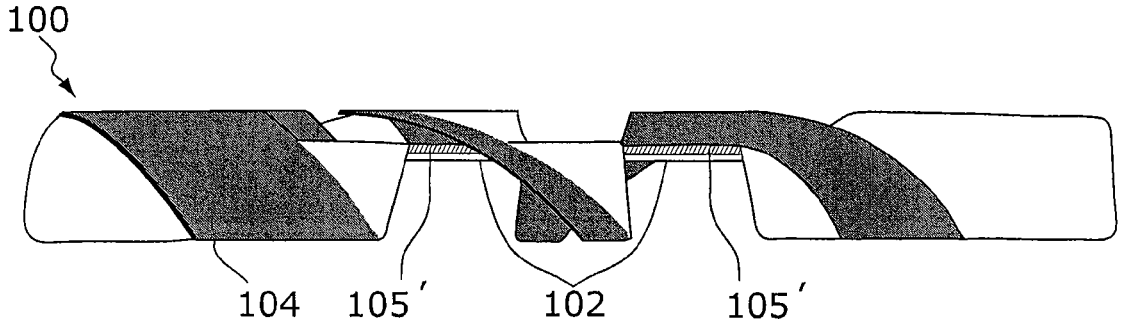
FIG. 5B is a side elevational view of FIG. 3 including an adhesive fastener.
Figure 6:
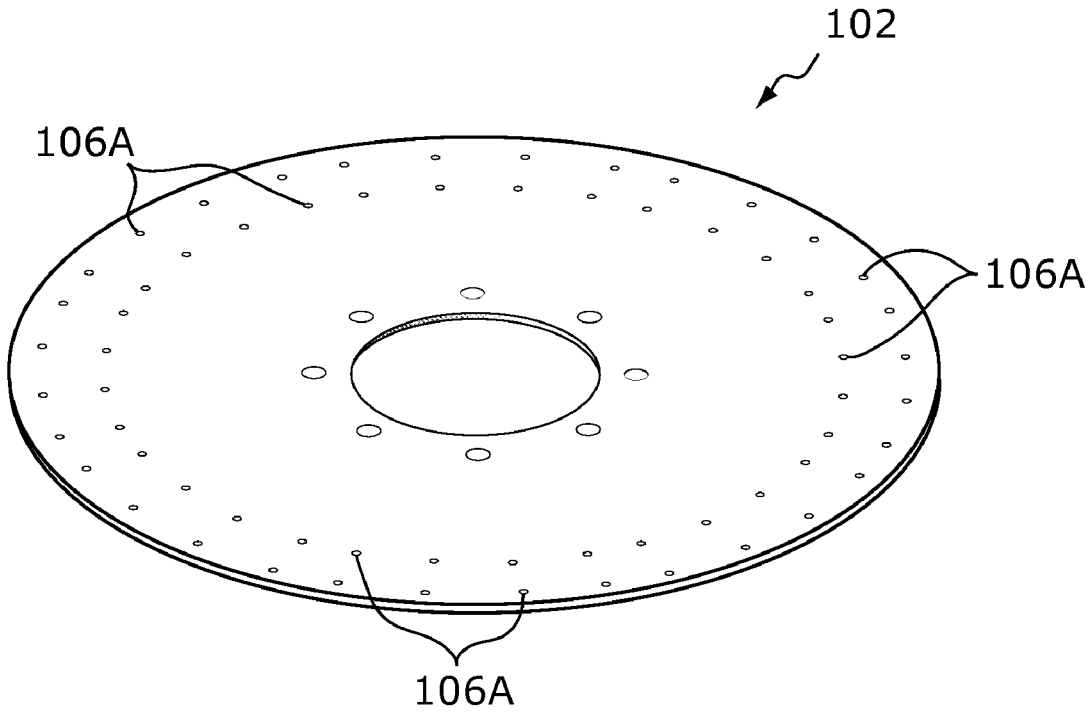
FIG. 6 is a perspective view of the hub portion of the embodiment of FIG. 3.
Figure 7:
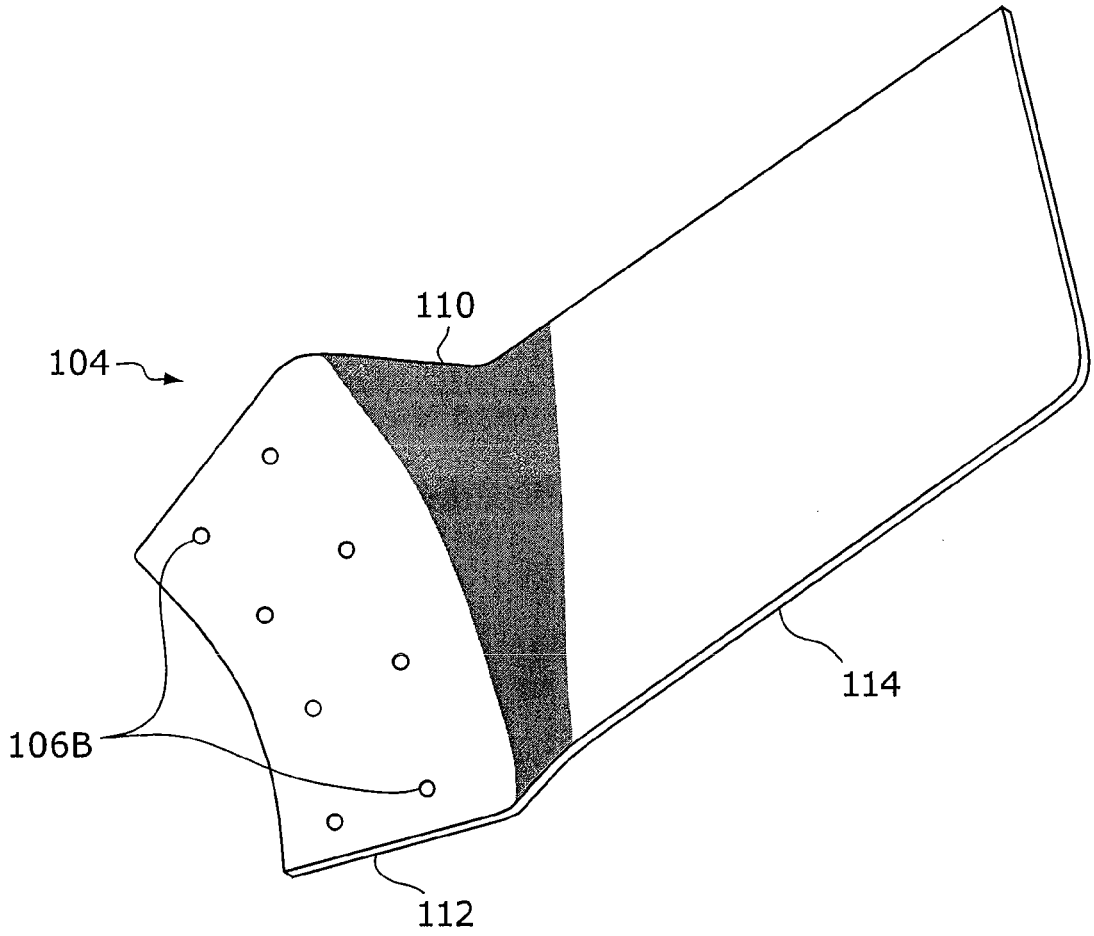
FIG. 7. is a rear perspective view of a fan blade portion of the embodiment of FIG. 3.
Figure 8:
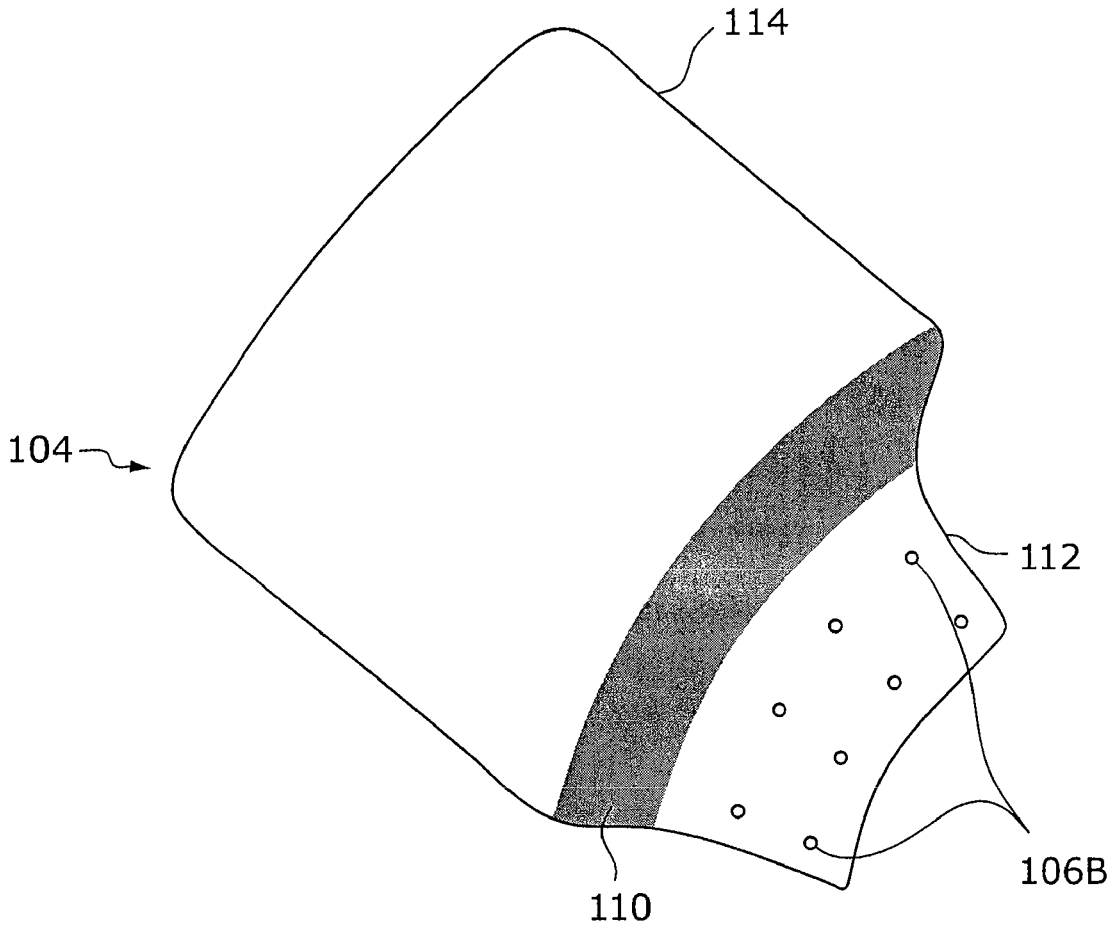
FIG. 8 is a front perspective view of FIG. 7.

Moreover, the shape of the fan blade system 100 differs from the conventional spider/legs/blades configuration by utilizing a single circular disk hub 102 from which a plurality of uniquely shaped blade members 104 extend. The center hub 102 is adapted to be easily and quickly produced by laser cutting to fit a customer's desired specifications. No spider legs are required because each blade 104 is formed having a predetermined pitch and is attached directly to the round hub 102. The blades 104 are preferably attached directly to the hub 102 via at least one permanent (i.e., non-removably reattachable) mechanical fasteners 105 through preformed apertures 106A, 106B when the apertures 106A, 106B are lined up so as to overlap as shown in FIGS. 5A and 6. Alternatively, the blades 104 may be attached to the hub 102 via permanent adhesives or via chemical bonding processes 105'. (See FIG. 5B).

Moreover, rather than having the pitch twist contained in the legs, as in conventional axial fans 10, the system 100 positions the pitch twist inherently within the blades 102 themselves. The pitch twist is molded into the blade 104, such that the aforementioned weakening and embrittling is avoided. As may be seen in FIGS. 7 and 8, each blade 104 includes a pitch twisted transition portion 110 connecting a generally substantially planar hub-engaging portion 112 (through which the pre-drilled or otherwise pre-formed apertures 106B are formed) to a generally substantially planar air-engaging or blade portion 114. Typically, the pitch-twisted portion 110 has a finite twist angle, such that the hub-engaging portion 112 and blade portion 114 are connected therethrough and oriented relative one another at a non-zero angle as defined by the degree of pitch twist. As noted above, it is preferred that blade (i.e., the transition, hub-engaging, and blade portions 110, 112, and 114) be simultaneously formed through a low-pressure compression molding process. In other words, transition portion 110 is contiguous with the substantially planar hub-engaging and blade portions 112, 114, and the three portions 110, 112, 114 are typically simultaneously formed as a unitary, contiguous piece.

Figure 9:
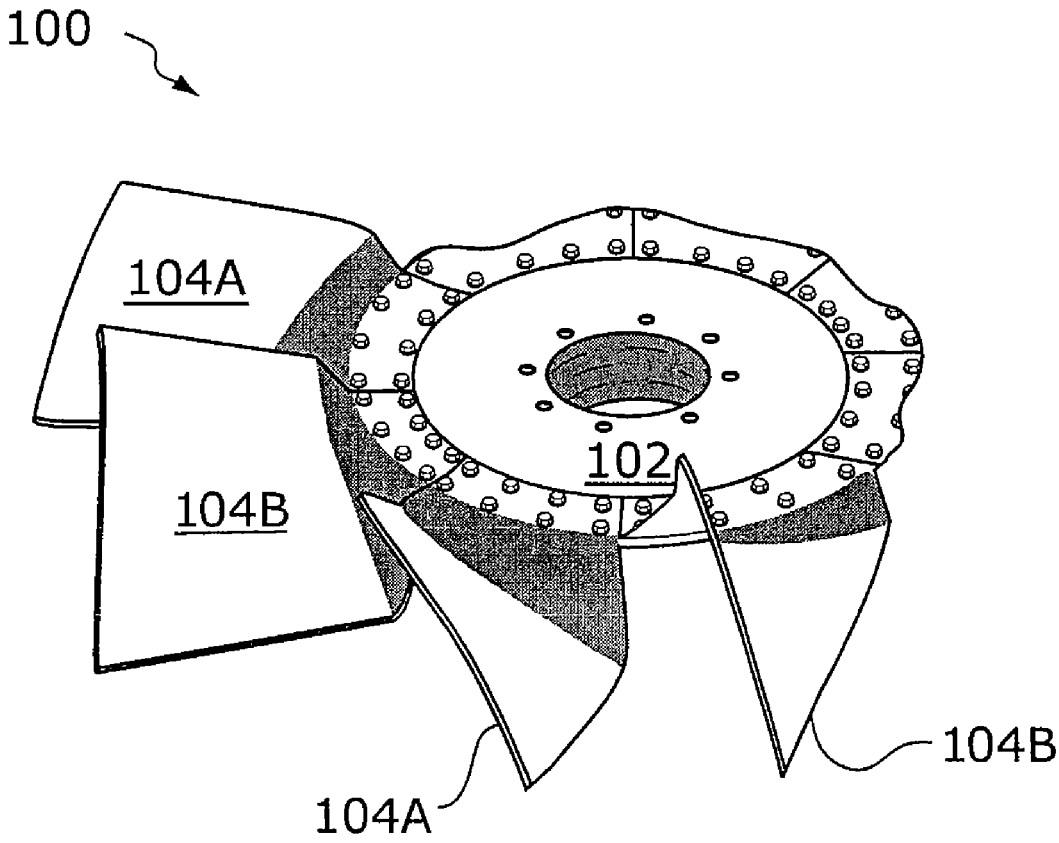
FIG. 9 is a perspective view of another embodiment of a fan blade assembly including a hub portion to which a two pluralities of independently formed fan blade portions characterized by first and second dissimilar pitch angles are directly connected.

Consequently, a single center hub 102 of a predetermined diameter may be used universally as the appropriate blades 104 having the desired pitch are selected and secured to the hub 102. As the blades 104 are constructed from (preferably vinyl ester) thermoset resin, the blades 104 may be easily designed and produced in many desired shapes and pitch variances for use with the same universal hub 102. For instance, two sets of blades 104A, 104B, at different pitch angles (as defined by the intermediate portions 110A, 110B) may be attached to hub 102 such that the blades defining the first pitch angle 104A alternate with the blades defining the second pitch angle 104B. (See FIG. 9). Typically, the plurality of blades from each set are spaced substantially evenly around the hub disc. In other words, the system 100 is flexible insofar as blades 104 defining any desired pitch angle may be attached at any desired frequency and/or in any desired number to the hub 102. Such ease of manufacture would be difficult and prohibitively expensive to achieve with steel, aluminum, or nylon blades. The fan blades 104 can be manufactured quickly upon demand, again reducing costs.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A fan assembly, comprising:

a hub having a pattern of through-holes, said hub having a substantially planar face;

a plurality of fan blades positioned substantially evenly around said hub; and a plurality of fasteners connecting said fan blades to said hub;

wherein each said fan blade further comprises;

an attachment portion having a substantially planar face and a plurality of through-holes; and a curved air-engaging portion twisted relative to said attachment portion;

wherein each said fan blade is formed from a composite material having a thermoset resin matrix phase and a continuous fiber reinforcement phase;

wherein the continuous fiber reinforcement phase is substantially evenly dispersed in the thermoset resin matrix phase and wherein the planar face of said hub is in contact with the planar face of each said blade, each said fastener extending through a hole of said hub and a corresponding hole of said blade.

2. The assembly of claim 1 wherein the thermoset resin phase is a vinyl ester.

3. The assembly of claim 1 wherein the continuous fiber reinforcement phase is a fabric.

4. The assembly of claim 1 wherein the continuous fiber reinforcement phase is glass.

5. The assembly of claim 1 wherein the continuous fiber reinforcement phase is woven.

6. The assembly of claim 1 wherein the continuous fiber reinforcement phase is mat.

7. The assembly of claim 1 wherein said fasteners are permanent.

8. The assembly of claim 1 wherein each said elongated fan blade is characterized by a strength to weight index of at least about 340 PSI per pound.

* * * * *